United States Patent [19]

Bonfiglioli

[11] Patent Number: 4,546,744

[45] Date of Patent: Oct. 15, 1985

[54] ELECTROMECHANICAL AND PNEUMATIC DEVICE FOR CONTROLLING THE THROTTLE POSITION OF A CARBURETOR ACCORDING TO ENGINE SPEED DURING ACCELERATOR RELEASE

[75] Inventor: Silverio Bonfiglioli, Zola Predosa, Italy

[73] Assignee: Weber S.p.A., Torino, Italy

[21] Appl. No.: 577,013

[22] Filed: Feb. 6, 1984

[30] Foreign Application Priority Data

Feb. 18, 1983 [IT] Italy ..... 3342 A/83

[51] Int. Cl.[4] ..... F02M 3/06; F02D 31/00

[52] U.S. Cl. ..... 123/339; 123/360; 123/361

[58] Field of Search ..... 123/339, 360, 361

[56] References Cited

U.S. PATENT DOCUMENTS 3,648,798 3/1972 Jania ..... 123/360 X 4,176,633 12/1979 McCabe ..... 123/360

4,274,376 6/1981 Tsiang et al. ..... 123/360

*Primary Examiner*—Tony M. Argenbright

*Attorney, Agent, or Firm*—Stevens, Davis, Miller & Mosher

[57] ABSTRACT

A device for controlling the throttle position of a carburetor during an accelerator release stage, in accordance with the speed of the engine. The device includes a vacuum motor which acts on a control lever associated with the carburetor throttle and which is in fluid communication with the intake suction manifold of the engine and with the atmosphere. An electromagnet device is energized by a control device which receives signals representing various engine parameters as detected by sensing devices. The electromagnet device includes a movable keeper including a bushing which slides between a pair of abutments under the effect of the magnetic field created by the electromagnets of the electromagnet device and of a spring which opposes the force applied by the magnetic field. The bushing includes a valve member which controls a pipe in order to place the vacuum motor in communication with the atmosphere.

4 Claims, 5 Drawing Figures

C
K
RPM
$T_{H2O}$

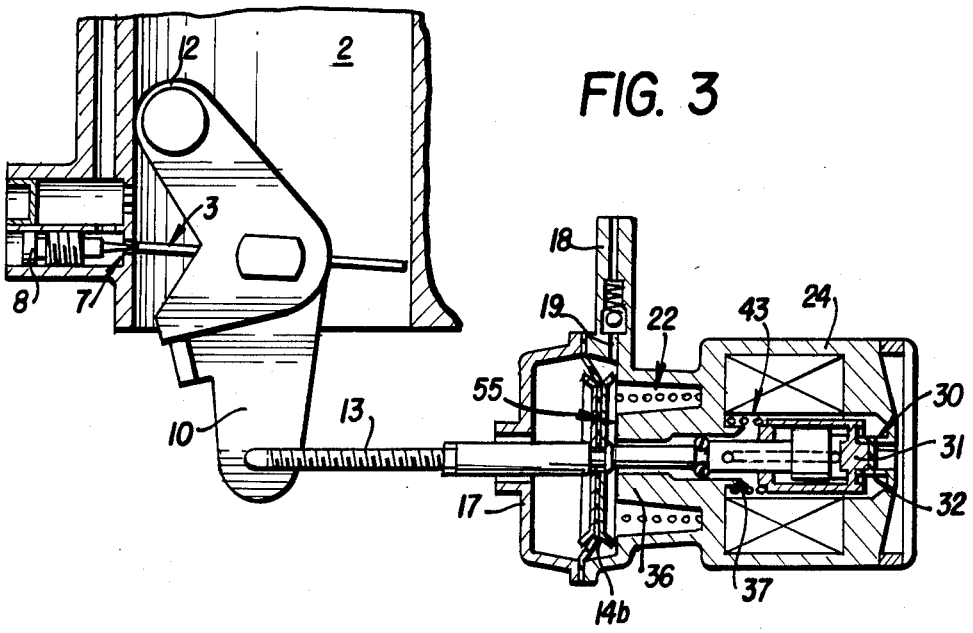
FIG. 3
FIG. 4
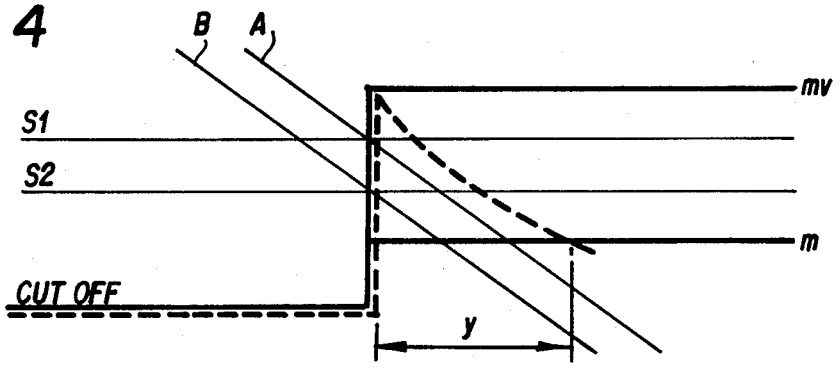
FIG. 5
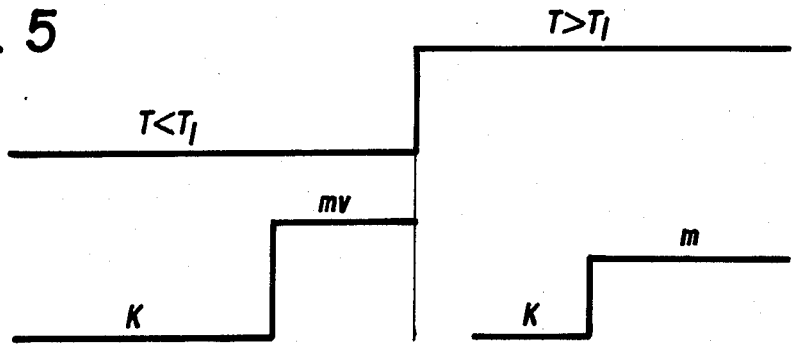

ELECTROMECHANICAL AND PNEUMATIC DEVICE FOR CONTROLLING THE THROTTLE POSITION OF A CARBURETOR ACCORDING TO ENGINE SPEED DURING ACCELERATOR RELEASE

This invention relates to a device comprising electromechanical and pneumatic elements, which, when the accelerator has been released, all cooperate in determining the position of the main throttle of a carburetor for a motor vehicle engine under the control of an electronic control unit, which receives electrical signals coming from appropriate sensors, these signals being representative of the engine's operating ranges.

It is known that the problems to be worked out by the modern carburetor are essentially as follows: to bring the main throttle into a fast idle position during the engine's cranking phases, in order to minimize the cranking times; to bring the same throttle into an "idle speed" position, when the engine has reached its thermal steady state condition; to bring the same throttle into a "cutoff" position, when the engine begins decelerating after the gas pedal has been released; to bring the throttle into a position of "fast idle", when starting a cold engine i.e., during the warm-up phases of the engine; to bring the throttle into a "cut-off" position, when stopping the engine, in order to prevent self-ignition i.e., the dieseling phenomenon; to allow the idle speed to be adjusted when the engine is warm, by setting the throttle depending on a load applied to the engine (as, for instance, an air conditioner) during an accelerator re-release stage. At present these problems are worked out by means of a certain number of devices of mechanical or of electromagnetic type; moreover, no device is known from the prior art, capable of solving all of above problems alone.

An object of this invention is to overcome the deficiencies of the prior art. The present invention, as characterized below, provides a device for carburetor, whereby all functions involved by the above tasks are made available.

The advantages achieved with this invention are the following: a unique device carries out the previously listed functions, thus working out tasks of constructional savings, of easy fitting on the carburetor and of minimizing overall dimensions; said device is capable of optimizing the engine's functions, in order to reduce both fuel consumption and emission of pollutants said device also makes it possible to lower the threshold speed, at which fuel is fed again after a cut-off phase, that results in a further reduction of fuel comsumption.

The invention is hereafter described, by referring to the attached drawings which show a preferred embodiment and operating of diagrams of the same.

Figure 1:
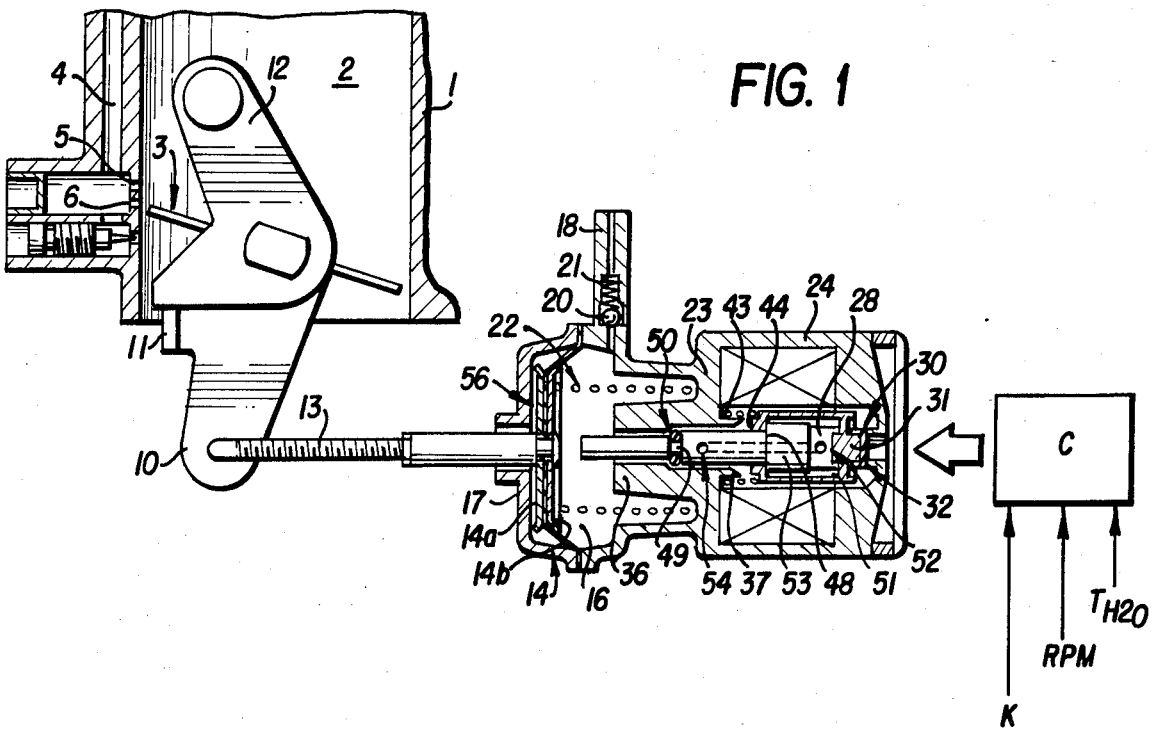
Figure 2:
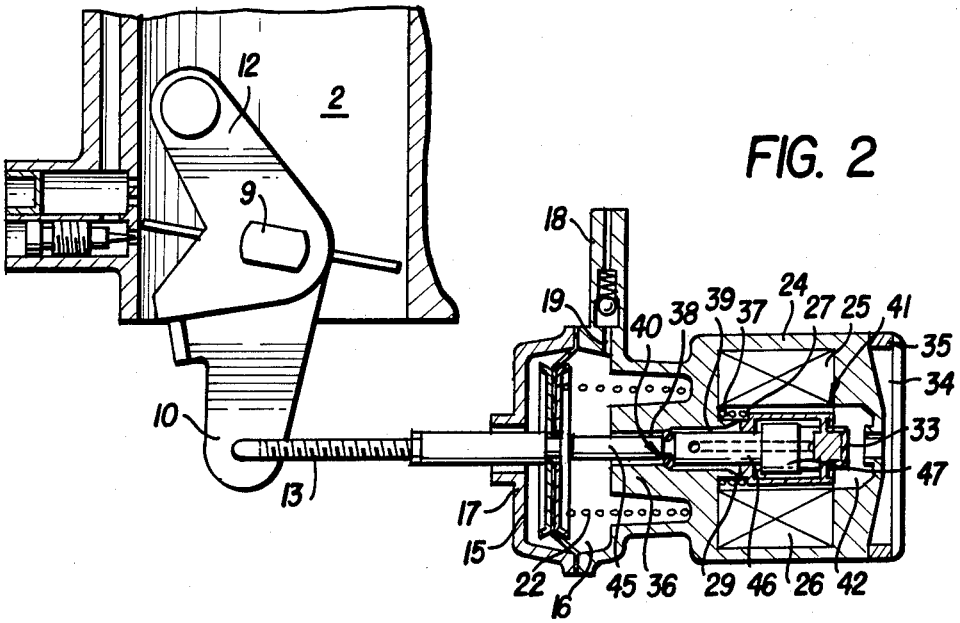

In FIG. 1 a device according to the present invention is shown, which cooperates with a control unit to bring the main throttle of a carburetor into a first position;

In FIG. 2 the same members, as shown in FIG. 1, are represented, wherein the throttle is found in a second position;

In FIG. 3 the same members, as shown in the preceding figures, are represented, but with throttle being set on a third position;

In FIG. 4 a positioning diagram is shown, concerning the throttle of a carburetor known from prior art and of a carburetor as afforded by this invention and;

In FIG. 5 a positioning diagram is shown, representing the throttle of a carburetor as afforded by this invention.

In FIGS. 1 and 2 a carburetor 1 is shown, provided with a main barrel 2, a throttle 3, an idle speed system 4 opening into the barrel 1 through two progression holes 5 and 6 and through an idle mixture orifice 7 as well; the section of orifice 7 is adjusted in a known way by an adjusting screw with tapered point 8. The main throttle 3 rotates with shaft 9, on which a first lever 10 is free to rotate. Lever 10 includes stopping means 11 for a second lever 12 which controls throttle 3; lever 12 is connected with the accelerator tie rod, not shown, and is keyed on shaft 9 as known from prior art. One end of a tie rod 13 is hinged on lever 10 and is integral to two small plates **14*a* and 14*b*, which make the middle of a membrane or diaphragm 14 stiff, this membrane being suited to divide the inner side of a pneumatic capsule or vacuum motor 17 into two chambers 15 and 16, not in communication with each other. The chamber 15 opens into the atmosphere through orifice 40; the chamber 16 communicates with the engine's intake suction manifold through a union or conduit, not shown, which is inserted into a small hose 18 coming from the said capsule or vacuum motor 17, in order to put the chamber 16 in communication with the vacuum existing in the intake suction manifold in order to create a vacuum in chamber 16**.

An inlet orifice 19, through which small hose 18 enters the chamber 16, is adjusted by a check valve, made up by a small ball 20 and by a spring 21, and so shaped as to put the chamber 16 immediately in communication with the manifold, when the pressure established inside the manifold is lower or approximately equal to the one existing inside the chamber 16, and as to slow down the opposite function after an appropriate delay.

The chamber 16 contains a spring 22 located between the small plate **14*b* and a wall 23; spring 22 is so sized as to hold up translations of the membrane 14 to the right hand side of FIGS. 1–3 under the effect of the vacuum existing inside the chamber 16, so that the tie rod 13 is shifted to the left and kept shifted, when the chamber 16 is not under vacuum. The wall 23 separates the capsule or vacuum motor 17 from a casing 24 containing an electromagnet 25, the winding 26** of which is fed with an electric current coming from a control unit C through electrical connectors, not shown.

The central unit C is not described as to its electrical elements, which are not concerned by this invention; yet, with a view to a better understanding of the following description, we say that it is fed with electrical signals issued by at least three sensors, namely: a sensor for cooling water temperature, a sensor for the engine's rotating speed rate (e.g., in R.P.M.s) and, at last, a sensor for the load applied to the engine by a power user, as, by way of example, by an air conditioner. Two of the three signals are advantageously of ON/OFF type and signal, respectively, whether the water temperature is under or above a certain preset value and whether the air conditioner is 'on' or 'off'; the remaining signal is issued from a winding of the starting ignition distributor coil.

The output signal of the central unit C is of ON/OFF type, too; yet, under certain conditions ('fast idle speed') the central unit C feeds the electromagnet 25 with signals, in order to make it operate according to a 'duty-cycle', even variable. Electromagnet 25 is provided with a movable keeper comprising a bushing 27, made of a low-hysteresis ferromagnetic material, that includes a cavity 28, a frusto-conical end 29 and a rear wall 30; wall 30 is provided with a hub 31, that supports, by means of drafts, a seal 32 suited to shut off an opening 33, connecting the inner side of casing 24 with a cavity 34, which opens into the atmosphere through a filter 35. The wall 23 supports two hubs 36 and 37, entering, respectively, the chamber 16 and the inner side of the casing 24; a first pipe 38 passes through the hub 36, and is provided with a first given diameter. A second pipe 39 passes through the hub 37 and has a second given diameter, this second diameter being larger than the first one; a taper 40 puts the two pipes 38 and 39 in communication.

The bushing 27 has a side wall 41 the form of a hexagonal prism, that, being accomodated on an inner side 42 of casing 24, having a cylindrical form, enables cavity 34 and the chamber 16 to establish communication with each other, when the seal 32 is far away from the opening 33. Indeed, six pipes take place between wall surface 41 and the said inner side 42, in series with respect to the above mentioned pipes 38 and 39.

A spring 43, located between a right side 60 of wall 23 and a ring-shaped rest surface 44, machined at the bottom of frusto-concical end 29, acts on the movable keeper 27, in order to hold up the effect of magnetic forces, when the electromagnet 25 is energized, and to give seal 32 the force necessary for shutting off the opening 23. A valvular member, comprising three cylindrical pieces 45,46 and 47, which are arranged in succession on the same axis and integral to each other, is positioned inside the device; the first piece 45 passes through pipe 38; the second piece 46 is found inside the pipe 39 and inside the end 29, said pieces having a diameter smaller than the one of the pipes they enter, in order to enable air to flow from cavity 34 to chamber 16; the third piece 47 enters the cavity 28, where it is held up by an abutment 48, machined in cavity 28 in correspondance with the initial part of the end 29. A groove 49, machined between the two pieces 45 and 46, supports a ring seal 50, capable of shutting off taper 40 under the thrust generated by a spring 51 located inside the cavity 28 between the base of piece 47 and the side of the piece 30 facing the cavity 28.

In order to ensure a more effective pneumatic connection between opening 33 and pipe 38, the bushing 27 presents a plurality of radial holes 52, each of them putting one of the six pipes in communication with the cavity 28; moreover, for the same purpose, the same pieces 46 and 47 are passed through by an inner boring 53, represented by the dotted line in the Figures, and opening in a radial hole 54, located in pipe 39. At last, the capsule or vacuum motor 17 presents a first wall 55, against which the small plate **14*b* abuts under the effect of high vacuum established in chamber 16, and a second wall 56, on which the small plate 14*a* abuts under the sole action of the spring 22**.

I claim:

1. An apparatus for controlling a position of a carburetor throttle as a function of engine speed during accelerator release, comprising:

a housing including a first portion in which a vacuum motor is disposed and a second portion in which an electromagnet is disposed, said vacuum motor comprising a first and a second chamber hermetically divided from each other by an elastic diaphragm, said diaphragm including a stiffened middle portion comprising a pair of small plates, said vacuum motor including a first wall having a first opening for providing communication between said first chamber and an ambient surrounding said apparatus, said vacuum motor including a second wall having pipe means therein for providing communication between an intake manifold of said engine and said second chamber in order to transmit a vacuum existing in said manifold to said second chamber;

a first spring disposed in said second chamber, for biasing said diaphragm against action of said vacuum;

first and second stopping means disposed respectively in said first and second chambers, for stopping movement of said diaphragm between limit positions under action of said vacuum and said bias of said first spring;

a first cavity disposed in said second portion of said housing;

a first passage connecting said second chamber and said first cavity, for providing communication between said second chamber and said first cavity;

a second opening connecting said first cavity and said ambient, for providing communication between said first cavity and said ambient;

a valve member coaxial with a longitudinal axis of said housing and comprising a first part including a slide support, a second and a third part, said second part being disposed in said first cavity;

first sealing means supported by said valve member, for closing said first passage to prohibit said communication between said second chamber and said first cavity;

a throttle shaft on which said throttle is fixed such that said throttle rotates with said shaft;

a first lever connected to said shaft of said throttle;

a rod fixed to said middle portion of said diaphragm and crossing said slide support in said first part of said valve member, said rod extending substantially coaxially with said longitudinal axis of said housing, to act on said first lever connected to said shaft of said throttle;

control means for energizing said electromagnet device, said control means being electrically connected with at least a first sensor for sensing cooling water temperature of said engine, a second sensor for sensing an R.P.M. value of said engine, a third sensor for sensing a power load applied to said engine, when an accelerator is released, and said electromagnet device;

a bushing comprising a second cavity, said bushing constituting a movable keeper associated with said electromagnet device, said third part of said valve member being slidably disposed in said bushing;

a second spring disposed in said first cavity for biasing said movable keeper against an action of said electromagnet when said electromagnet is energized;

second sealing means supported by said bushing, for closing said second opening under said biasing action of said second spring;

conduit means disposed in said first cavity, for providing communication between said second opening and said first passage;

a third spring disposed in said second cavity, for biasing said valve member against inertial forces of said valve member;

said first part of said first valve member being disposed in said second chamber and cooperating with said stiffened middle portion of said diaphragm in order to position said diaphragm.

2. The apparatus as in claim 1, wherein a second lever is fixed to said throttle shaft, said second lever being connected to a tie rod of said accelerator and being freely mounted on said throttle shaft, said first lever including stopping means for stopping movement of said second lever at a limit position.

3. The apparatus as in claim 1, wherein said third spring produces an elastic force which is less than a force of a magnetic field which acts on said movable keeper when said electromagnet device is energized.

4. The apparatus as in claim 1, wherein said pipe means for providing communication between said intake manifold and said second chamber includes a check valve which opens with a pre-determined time delay.

* * * * *